US011684928B2

(12) United States Patent
Zhong et al.

(10) Patent No.: US 11,684,928 B2
(45) Date of Patent: Jun. 27, 2023

(54) AUTOMATIC SHREDDER

(71) Applicant: Aurora Office Equipment Co., Ltd. Shanghai, Shanghai (CN)

(72) Inventors: Er Ren Zhong, Shanghai (CN); Tao Kuei Chuang, Shanghai (CN); Guanglong Chen, Shanghai (CN)

(73) Assignee: Aurora Office Equipment Co., Ltd. Shanghai, Shanghai (CN)

( * ) Notice: Subject to any disclaimer, the term of this patent is extended or adjusted under 35 U.S.C. 154(b) by 210 days.

(21) Appl. No.: 17/204,717

(22) Filed: Mar. 17, 2021

(65) Prior Publication Data

US 2022/0118460 A1 Apr. 21, 2022

(30) Foreign Application Priority Data

Oct. 20, 2020 (CN) ..... 202011128737.3

(51) Int. Cl.
*B02C 18/00* (2006.01)
*B02C 18/22* (2006.01)
*B02C 18/14* (2006.01)

(52) U.S. Cl.
CPC ..... *B02C 18/0007* (2013.01); *B02C 18/2283* (2013.01); *B02C 18/142* (2013.01); *B02C 2018/003* (2013.01); *B02C 2018/0038* (2013.01); *B02C 2018/0046* (2013.01); *B02C 2018/2208* (2013.01)

(58) Field of Classification Search
CPC ..... B02C 18/0007; B02C 18/2283
See application file for complete search history.

(56) References Cited

U.S. PATENT DOCUMENTS 4,192,467 A * 3/1980 Hatanaka ..... B30B 9/3089 241/34
8,196,851 B2 * 6/2012 Aries ..... B02C 18/2291 241/236
8,439,286 B2 * 5/2013 Pan ..... B02C 18/0007 241/166
8,651,404 B2 * 2/2014 Chang ..... B02C 18/2225 241/236
8,672,251 B2 * 3/2014 Aries ..... B02C 23/08 241/236
8,727,255 B2 * 5/2014 Kim ..... B02C 23/02 241/236
9,776,191 B2 * 10/2017 Schwelling ..... B02C 18/2283
2004/0164192 A1 * 8/2004 Chang ..... B02C 18/0007 241/100
2008/0210794 A1 * 9/2008 Schwelling ..... B02C 18/0007 241/34

(Continued)

*Primary Examiner* — Faye Francis
(74) *Attorney, Agent, or Firm* — WHGC, P.L.C.; John F. O'Rourke; Alexander R. Schlee

(57) ABSTRACT

An automatic shredder having an upper shredder cover, a lower shredder cover, a first paper box, a second paper box, a shredder cover plate, a paper pressing plate, a paper pressing roller set, a paper pick-up roller set, a paper inlet, a cutter shaft set, a drive motor, a shell and a waste paper barrel. The automatic shredder adopts a bent paper box to change the length of to-be-shredded paper by means of the flexibility and bendability of paper and the features of paper pick-up rollers on one side, is extremely simple and economical, and changes the flat paper placement structure of existing automatic shredders.

29 Claims, 7 Drawing Sheets

(56) References Cited

U.S. PATENT DOCUMENTS

| | | | | |
|---|---|---|---|---|
| 2012/0018554 | A1* | 1/2012 | Seo | B02C 18/2283 241/101.2 |
| 2015/0258549 | A1* | 9/2015 | Ahn | B02C 18/0007 241/285.3 |
| 2015/0328642 | A1* | 11/2015 | Shegerian | B02C 18/2216 241/37.5 |
| 2015/0343451 | A1* | 12/2015 | Xu | B65H 3/047 241/34 |
| 2016/0236201 | A1* | 8/2016 | Aries | B02C 23/08 |
| 2016/0318031 | A1* | 11/2016 | Chang | B02C 18/2241 |
| 2018/0008987 | A1* | 1/2018 | Tsai | B02C 25/00 |

* cited by examiner

AUTOMATIC SHREDDER

CROSS-REFERENCE TO RELATED APPLICATIONS

The present application claims priority under 35 U.S.C. 119 to Chinese patent application no. 202011128737.3, filed Oct. 20, 2020, and entitled "An automatic paper shredder with a curved paper structure," which Chinese patent application is incorporated by reference herein in its entirety. The present Application is further related to issued U.S. Pat. No. 10,875,029, entitled "Paper scrap pushing structure of paper shredder," issued Dec. 29, 2020, which patent is incorporated by reference in its entirety.

BACKGROUND

Technical Field

The invention relates to the field of paper shredders, in particular to an automatic paper shredder.

Description of Related Art

Automatic paper shredders on the present market, having two sets of paper pick-up rollers for feeding paper symmetrically or one set of paper pick-up rollers for feeding paper asymmetrically, are additionally provided with protective walls corresponding to two ends of paper and need to accommodate long edges of the paper, thus being large in outline dimension and unable to fully compress the paper length to simplify the structure.

To solve the above-mentioned problems, the invention provides a solution to improving existing automatic shredders, such as U.S. Pat. No. 8,201,766B2, filed Jul. 27, 2009, and issued Jun. 19, 2012, entitled "Pins or staples removable structure of automatic shredders," which hereby is incorporated by reference herein in its entirety.

BRIEF SUMMARY OF THE INVENTION

The objective of the invention is to overcome the defects of the prior art by providing an automatic shredder, which adopts a bent paper box to change the length of to-be-shredded paper by means of the flexibility and bendability of paper and the features of paper pick-up rollers on one side, is extremely simple and economical, and changes the flat paper placement structure of existing automatic shredders.

To fulfill the aforesaid objective, the technical solution adopted by the invention to solve the technical problems is as follows:

An automatic shredder comprises an upper shredder cover, a lower shredder cover, a first paper box, a second paper box, a shredder cover plate, a paper pressing plate, a paper pressing roller set, a paper pick-up roller set, a paper inlet, a cutter shaft set, a drive motor, a shell and a waste paper barrel. The upper shredder cover is fixedly connected to the lower shredder cover. The first paper box is disposed at one end of an inner side of the lower shredder cover. The second paper box is disposed at the other end of the inner side of the lower shredder cover, and is communicated and combined with the first paper box to accommodate a stack of to-be-shredded paper. The shredder cover plate is connected to one end of the upper shredder cover through a pivot and is used for opening or closing the shredder. The paper pressing plate is fixedly connected to a lower end face of the shredder cover plate and at least comprises a horizontal pressing plate for pressing the stack of to-be-shredded paper placed on the first paper box when a user closes the shredder cover plate. The paper pressing roller set is disposed on one side of the paper pressing plate and vertically corresponds to the paper pick-up roller set. The paper inlet is formed in the first paper box. The cutter shaft set is disposed inside the lower shredder cover, located under the paper inlet and used for shredding the stack of to-be-shredded paper. The drive motor is disposed inside the lower shredder cover, electrically connected to the cutter shaft set and the paper pick-up roller set, and used for driving the cutter shaft set and the paper pick-up roller set to operate. The paper pick-up roller set is disposed inside the lower shredder cover, is located on a side, away from the second paper box, of the cutter shaft set and is driven by the drive motor to rotate to enable a bottom piece of paper in the stack of to-be-shredded paper on the paper support box to move towards the second paper box and then move reversely under a reactive force of a side wall of the second paper box to be bent and deformed at the paper inlet so as to downward enter the paper inlet. The shell is disposed below the lower shredder cover and is fixedly connected to the lower shredder cover. The waste paper barrel is disposed inside the shell and is used for collecting shredded paper.

Furthermore, the automatic shredder further comprises a staple accommodating groove concavely formed in an end, away from the second paper box, of the first paper box and used for collecting removed staples or clips. A staple removing plate is disposed on a bevel portion of a joint of the staple accommodating groove and a bottom plane of the first paper box. In an embodiment, the first paper box and the second paper box are manufactured integrally or separately. In an embodiment, when the first paper box and the second paper box are manufactured separately, the second paper box and the first paper box are connected to the upper shredder cover in a screwed manner, a clamped manner, a riveted manner or a welded manner. In an embodiment, the sum of the length of the first paper box and the length of the second paper box is equal to the paper length of the to-be-shredded paper. In an embodiment, the length of the second paper box is smaller than or equal to half of the paper length. In an embodiment, the length of the second paper box is smaller than or equal to a quarter of the paper length. In an embodiment, the width of an inlet of the second paper box is equal to that the first paper box.

Furthermore, the second paper box is a common paper box, a downward bent paper box or an upward bent paper box. In an embodiment, when the second paper box is the common paper box, an upper surface of the second paper box and an upper surface of the first paper box are located on the same plane and are horizontal or oblique. In an embodiment, an angle between a side wall, away from the first paper box, of the second paper box and the bottom plane of the first paper box is smaller than or equal to 90 degrees. Furthermore, the paper pressing plate further comprises a vertical pressing plate, the horizontal pressing plate presses the stack of to-be-shredded paper on the first paper box, and the vertical pressing plate presses a portion of the stack of to-be-shredded paper, close to the staple accommodating groove, into the staple accommodating groove. In an embodiment, when the second paper box is the downward bent paper box, the downward bent paper box is a semi-open downward bent cavity formed by a downward bent paper box upper wall, a downward bent paper box paper-stop wall and a downward bent paper box lower wall connected in sequence, is fixedly connected to the lower shredder cover, and is communicated and combined with the first paper box to accommodate the stack of to-be-shredded paper. In an embodiment, the bottom plane of the first paper box inclines downward gradually from an end away from the downward bent paper box to an end close to the downward bent paper box. In an embodiment, an angle between the downward paper box paper-stop wall and the bottom plane of the first paper box is smaller than or equal to 90 degrees.

Furthermore, portions, close to the downward bent paper box paper-stop wall, of left and right ends of the downward bent paper box lower wall expand outward to form first staple accommodating boxes respectively. Bevel portions of joints of the left and right first staple accommodating boxes and the downward bent paper box lower wall are used for removing staples or clips on a bottom piece of paper in the stack of to-be-shredded paper. Two inner side faces, facing each other, of the left and right first staple accommodating boxes are first staple removing part open faces, and are communicated with the waste paper barrel to remove redundant staples or clips. In an embodiment, the downward bent paper box upper wall, the downward paper box paper-stop wall, the first staple accommodating boxes and the downward paper box lower wall are integrally manufactured. Furthermore, first staple removing parts are disposed on the bevel portions of the joints of the left and right first staple accommodating boxes and the downward bent paper box lower wall. Furthermore, a plurality of first reinforcing ribs are disposed between upper sides of the first staple accommodating boxes and the downward bent paper box lower wall.

Furthermore, a first accommodating cavity is formed in the lower shredder cover to accommodate the downward bent paper box. In an embodiment, when the second paper box is the upward bent paper box, the upward bent paper box is a semi-open upward bent cavity formed by an upward bent paper box upper wall, an upward bent paper box paper-stop wall and an upward paper box lower wall connected in sequence, is fixedly connected to the upper shredder cover, and is communicated and combined with the first paper box to accommodate the stack of to-be-shredded paper. In an embodiment, the bottom plane of the first paper box inclines upwards gradually from an end away from the upward bent paper box to an end close to the upward bent paper box. In an embodiment, an angle between the upward bent paper box paper-stop wall and the bottom plane of the first paper box is smaller than or equal to 90 degrees.

Furthermore, portions, close to the upward bent paper box paper-stop wall, of left and right ends of the upward bent paper box lower wall expand outwards to form second paper accommodating boxes respectively. Bevel portions of joints of the left and right second staple accommodating boxes and the upward bent paper box lower wall are used for removing staples or clips on a bottom piece of paper in the stack of to-be-shredded paper. Two outer side faces, backing onto each other, of the left and right second staple accommodating boxes are second staple removing part open faces, and are communicated with the waste paper barrel through two through hole formed in two corners of the lower shredder cover to remove redundant staples or clips. In an embodiment, the upward bent paper box upper wall, the upward bent paper box paper-stop wall, the second staple accommodating boxes and the upward bent paper box lower wall are integrally manufactured.

Furthermore, second staple removing plates are disposed on the bevel portions of the joints of the left and right second staple accommodating boxes and the upward bent paper box lower wall. Furthermore, a plurality of second reinforcing ribs are disposed between upper sides of the second staple accommodating boxes and the upward bent paper box lower wall. Furthermore, a second accommodating cavity is formed in the upper shredder cover to accommodate the upward bent paper box.

By adoption of the above technical solution, the embodiments of the invention have the following advantages and beneficial effects compared with the prior art:

1. According to the automatic shredder of the invention, the bottom plane of the paper support box is oblique, thus being more conformable with the using habits of users and allowing the users to place a stack of to-be-shredded paper easily. Moreover, the friction between the to-be-shredded paper is distributed horizontally and vertically, thus being reduced.

2. According to the automatic shredder of the invention, staples and/or clips can be automatically removed, so that the paper shredding efficiency is greatly improved, and time is saved. Moreover, damage of the staples and/or clips to the whole shredder is prevented, so that the whole shredder is protected in use, and the service life of the shredder is prolonged.

3. The automatic shredder of the invention adopts a bent paper box to change the length of to-be-shredded paper by means of the flexibility and bendability of paper and the features of paper pick-up rollers on one side, is extremely simple and economical, changes the flat paper placement structure of existing automatic shredders, and has the characteristics of being high in degree of automation, convenient to use, safe, reliable, ingenious in design, simple in structure, economical, and the like.

BRIEF DESCRIPTION OF THE DRAWINGS

To more clearly explain the technical solutions of the embodiments of the invention, drawings used for the description of the embodiments will be briefly introduced below. Obviously, the drawings in the following description are merely for illustrating some embodiments of the invention, and those skilled in the art can obtain other drawings according to the following ones without creative labor. In the Figures.

Figure 1:
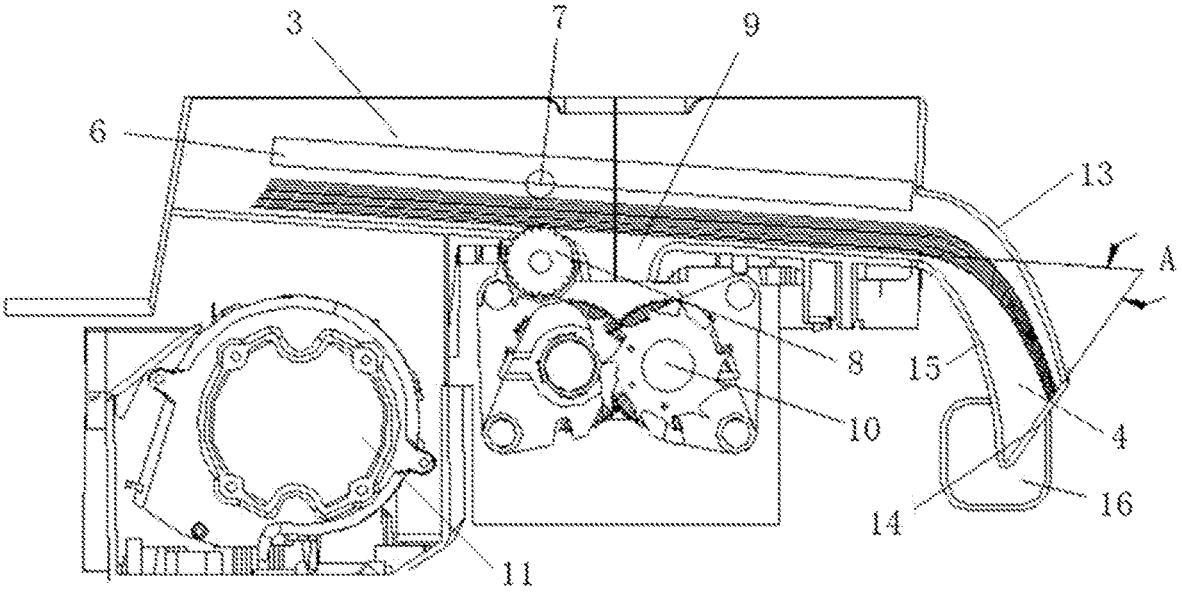
FIG. 1 is a first partial sectional view of an automatic shredder according to the teachings of the present invention.

Some embodiments are described in detail with reference to the related drawings. Additional embodiments, features and/or advantages will become apparent from the ensuing description or may be learned by practicing the invention. In the figures, which are not drawn to scale, like numerals refer to like features throughout the description. The following description is not to be taken in a limiting sense, but is made merely for the purpose of describing the general principles of the invention.

DETAILED DESCRIPTION OF THE INVENTION

To help those skilled in the art have a better understanding of the solution of the present application, the technical solutions of the embodiments of the present application will be clearly and completely described below in conjunction with the accompanying drawings of the embodiments. Obviously, the embodiments in the following description are merely illustrative ones, and are not all possible ones of the present application. All other embodiments obtained by those ordinarily skilled in the art on the basis of the following ones without creative labor should also fall within the protection scope of the present application.

As shown in FIG. 1-FIG. 13, an automatic shredder is disclosed, having upper shredder cover 1, lower shredder cover 2, first paper box 3, second paper box 4, shredder cover plate 5, paper pressing plate 6, paper pressing roller sets 7, paper pick-up roller sets 8, paper inlet 9, cutter shaft set 10, drive motor 11, shell 45 and waste paper barrel 40. Upper shredder cover 1 is fixedly connected to lower shredder cover 2. First paper box 3 is disposed at one end of an inner side of lower shredder cover 2. Second paper box 4 is disposed at the other end of the inner side of lower shredder cover 2, and is communicated and combined with first paper box 3 to accommodate a stack of to-be-shredded paper. Shredder cover plate 5 is connected to one end of upper shredder cover 1 through pivot 33, and is used for opening or closing the shredder. The paper pressing plate 6 is fixedly connected to a lower end of the shredder cover plate 5 and at least comprises a horizontal pressing plate 28 used for pressing the stack of to-be-shredded paper placed on the first paper box 3 when a user closes the shredder cover plate 5. The paper pressing roller sets 7 are disposed on one side of the paper pressing plate 6 and vertically correspond to the paper pick-up roller sets 8. In this embodiment, the number of the paper roller sets 7 and the number of the paper pick-up roller sets 8 are, but not limited to, two, and more or fewer paper pressing roller sets 7 and paper pick-up roller sets 8 are also within the protection scope of the embodiments herein.

The paper inlet 9 is formed in the first paper box 3. The cutter shaft set 10 is disposed inside the lower shredder cover 2, located under the paper inlet 9, and used for shredding the stack of to-be-shredded paper. The drive motor 11 is disposed inside the lower shredder cover 2, electrically connected to the cutter shaft set 10 and the paper pick-up roller sets 8 and used for driving the cutter shaft set 10 and the paper pick-up roller sets 8 to operate. The paper pick-up roller sets 8 are disposed inside the lower shredder cover 2, are located on a side, away from the second paper box 4, of the cutter shaft set 10 and are driven by the drive motor 11 to rotate to enable the bottom piece of paper in the stack of to-be-shredded paper on the first paper box 3 to move towards the second paper box 4 and then move reversely under a reactive force of a side wall of the second paper box 4 to be bent and deformed at the paper inlet 9 so as to downward enter the paper inlet 9. In this embodiment, the number of the paper pick-up roller sets 8 is two. In actual design, the number of the paper pick-up roller sets 8 will not be limited and may be three or more. In addition, the design idea of configuring the paper pick-up roller sets 8 on one side simplifies the paper pick-up structure and reduces economic costs. The shell 45 is disposed below the lower shredder cover 2 and is fixedly connected to the lower shredder cover 2. The waste paper barrel 40 is disposed inside the shell 45 and is used for collecting shredded paper.

Figure 12:
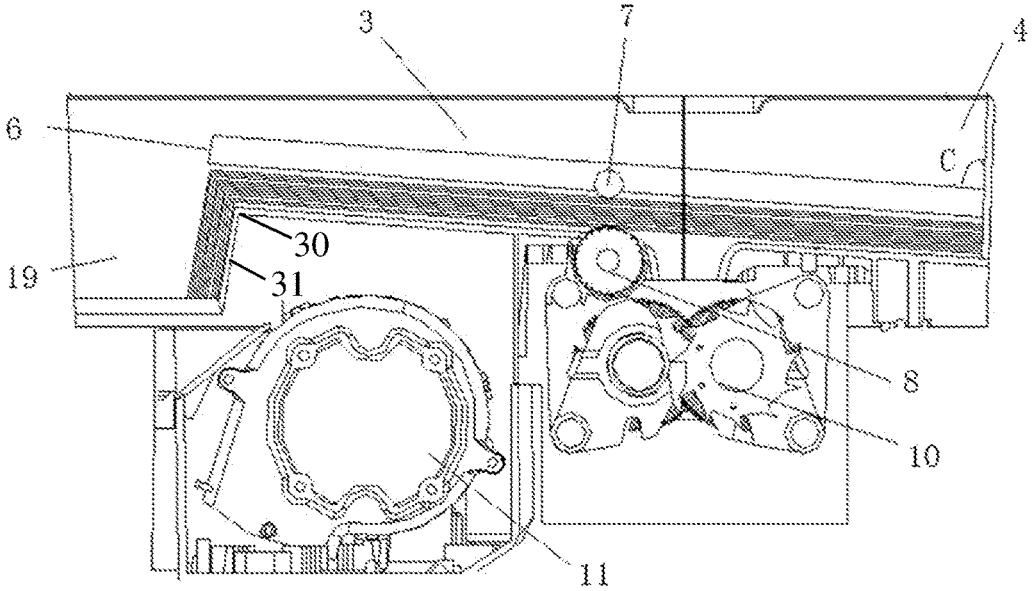
FIG. 12 is a structural view of a first paper pressing case of the automatic shredder according to the teachings of the present of the present invention.

As shown in FIG. 12, the automatic shredder further comprises a staple accommodating groove 19, which is concavely formed in an end of the first paper box 3 away from the second paper box 4, and used for collecting removed staples or clips. A staple removing plate 30 is disposed on a bevel portion of a joint of the staple accommodating groove 19 and a bottom plane of the first paper box 3.

In an embodiment, the first paper box 3 and the second paper box 4 are manufactured integrally or separately. When the first paper box 3 and the second paper box 4 are manufactured separately, the first paper box 3 and the second paper box 4 are fixedly connected to the upper shredder cover 1 in a screwed manner, a clamped manner, a riveted manner or a welded manner. Any connection manners that can fulfill a fixed connection effect should be within the protection scope of the invention. In an embodiment, the sum of the length of the first paper box 3 and the length of the second paper box 4 is equal to a paper length of the to-be-shredded paper, and the paper length is the length of lone sides of the paper by default. In this embodiment, the length of the second paper box 4 is smaller than or equal to half of the paper length, such that the length of the first paper box 3 can be minimized, thus greatly reducing the size of the shredder. In another embodiment, the length of the second paper box 4 is smaller than or equal to a quarter of the paper length, in this case, the paper pressing effect of the paper pressing plate 6 is better than that in the former case, and the paper pick-up effect is also better. However, the size of the shredder is a bit larger than that in the former case. In an embodiment, the width of an inlet of the second paper box 4 is equal to that of the first paper box 3, such that the stack of to-be-shredded paper on the first paper box 3 can be effectively prevented from moving leftwards or rightwards.

Figure 2A:
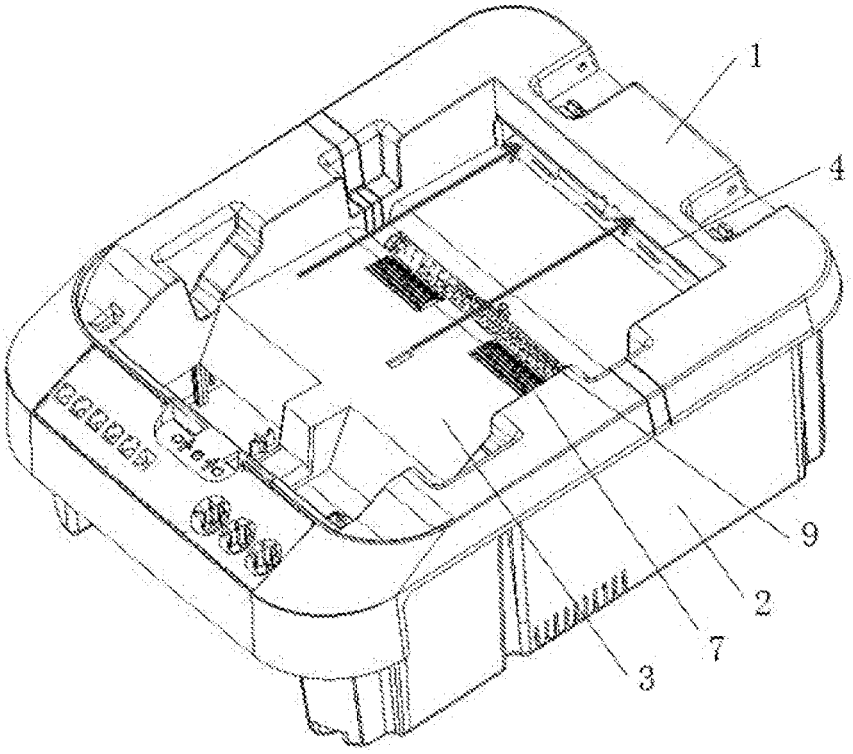
FIG. 2A is a structural view of a downward bent paper box mounted in a lower shredder cover of the automatic shredder according to the teachings of the present of the present invention.
Figure 2B:
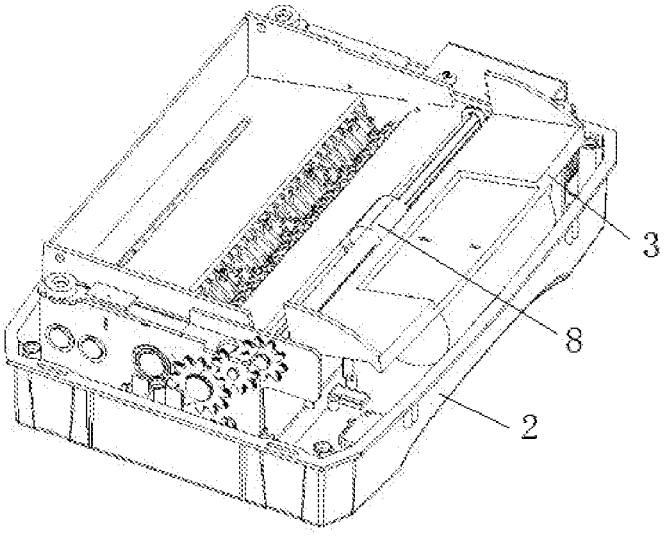
FIG. 2B is a structural view of the automatic shredder, with the upper shredder cover and a paper pressing plate being hidden, according to the teachings of the present of the present invention.
Figure 13:
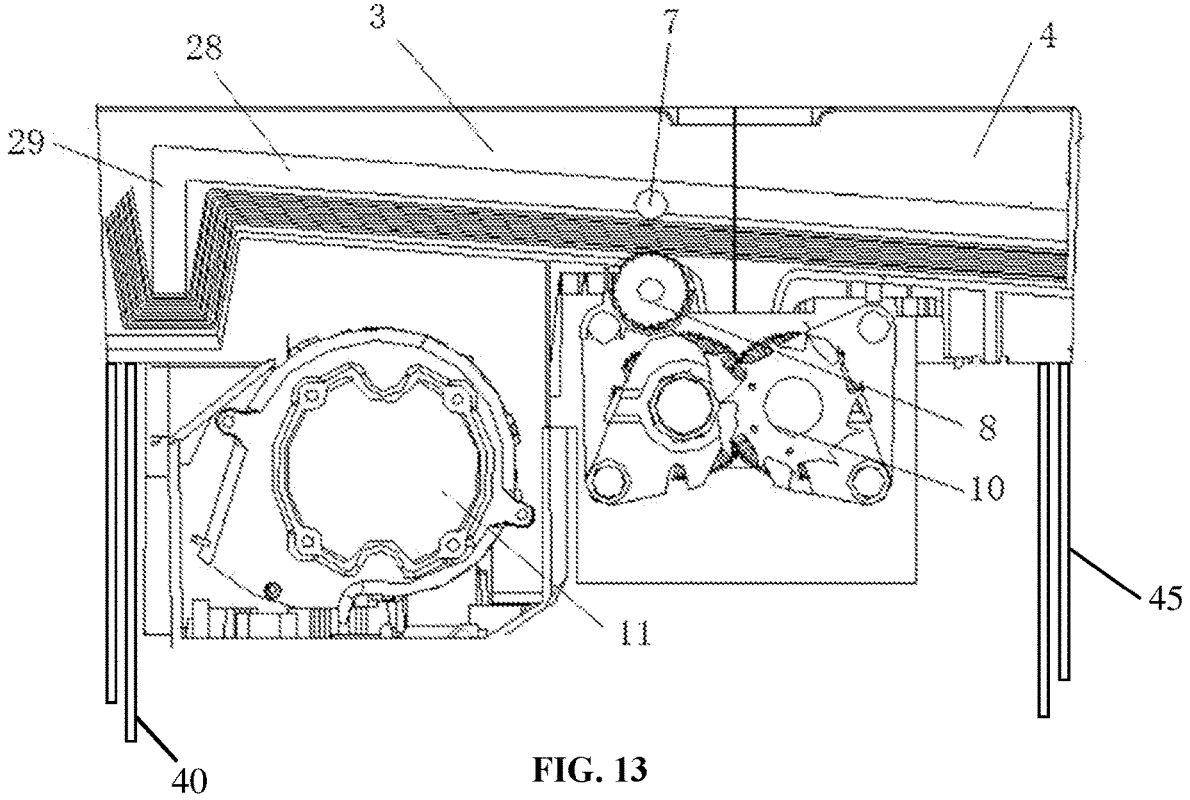
FIG. 13 is a structural view of a second paper pressing case of the automatic shredder according to the teachings of the present of the present invention.

Furthermore, the second paper box 4 is a common paper box, a downward bent paper box, or an upward bent paper box. Specifically, in one embodiment, when the second paper box 4 is the common paper box (as shown in FIG. 2B), an upper surface of the second paper box 4 and an upper surface of the first paper box 3 are located on the same plane and are horizontal or oblique. In an embodiment, an angle C between a side wall, away from the first paper box 3, of the second paper box 4 and the bottom plane of the first paper box 3 is smaller than or equal to 90 degrees, as shown in FIG. 12 and FIG. 13. Furthermore, as shown in FIG. 13, the paper pressing plate 6 further comprises a vertical pressing plate 29, wherein the horizontal pressing plate 28 presses the stack of to-be-shredded paper onto the first paper box 3, and the vertical pressing plate 29 presses a portion, close to the staple accommodating groove 19, of the stack of to-be-shredded paper into the staple accommodating groove 19.

In another embodiment, when the second paper box 4 is the downward bent paper box (as shown in FIG. 1, FIG. 2A, FIG. 3 and FIG. 6), the downward bent paper box is a semi-open downward bent cavity formed by a downward bent paper box upper wall 13, a downward bent paper box paper-stop wall 14 and a downward bent paper box lower wall 15 connected in sequence, is fixedly connected to the lower shredder cover 2, and is communicated and combined with the first paper box 3 to accommodate a stack of to-be-shredded paper (also suitable for a piece of paper).

In an embodiment, the bottom plane of the first paper box 3 inclines downwards gradually from an end away from the downward bent paper box to an end close to the downward bent paper box, so that the user can place the stack of to-be-shredded paper on the first paper box 3 easily, and the friction between the stack of to-be-shredded paper is reduced. In actual operation, the bottom plane of the first paper box 3 may also be horizontal, which is not most beneficial to paper placement. In this embodiment, the length of the downward bent paper box is half of the paper length, so that the length of the first paper box 3 can be minimized, thus reducing the size of the shredder. In another embodiment, the length of the downward bent paper box is smaller than or equal to a quarter of the paper length, in this case, the paper pressing effect of the paper pressing plate 6 is better than that in the former case, and the paper pick-up effect is also better. However, the size of the shredder is a bit larger than that in the former case.

Figure 3:
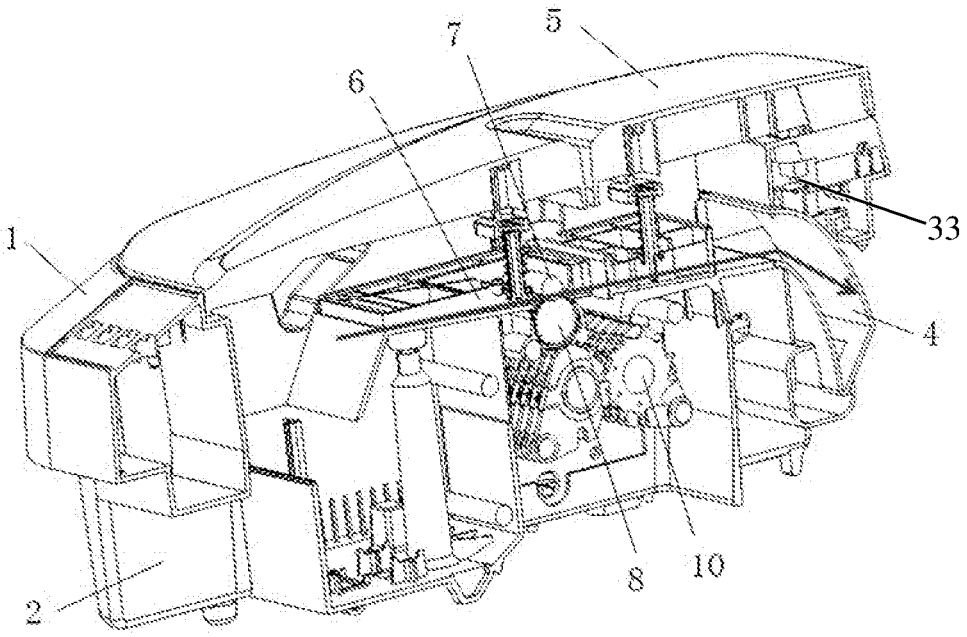
FIG. 3 is an overall sectional view of the automatic shredder according to the teachings of the present of the present invention.
Figure 4:
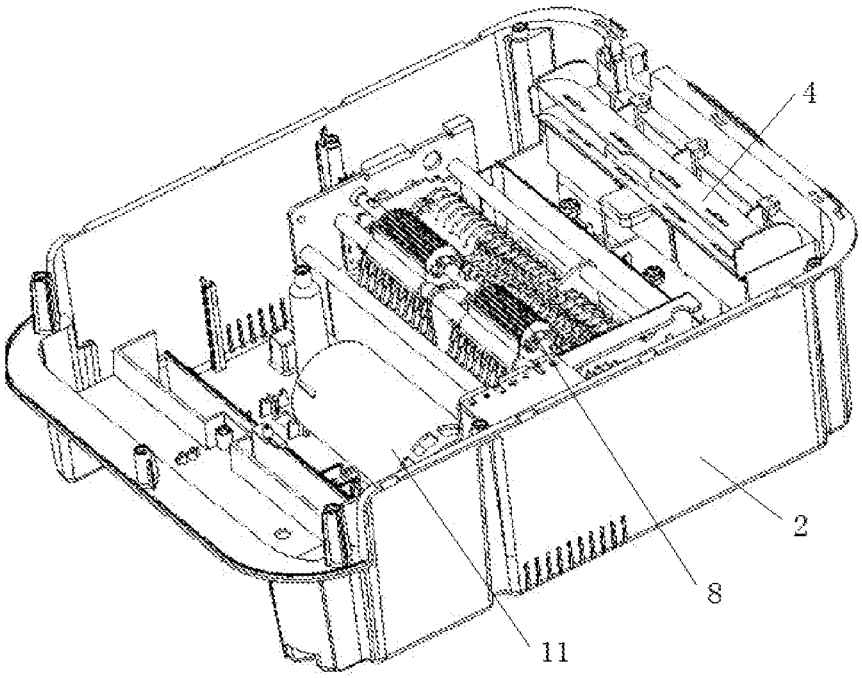
FIG. 4 is a structural view of the downward bent paper box mounted in the lower shredder cover of the automatic shredder, without the upper shredder cover according to the teachings of the present of the present invention.
Figure 6:
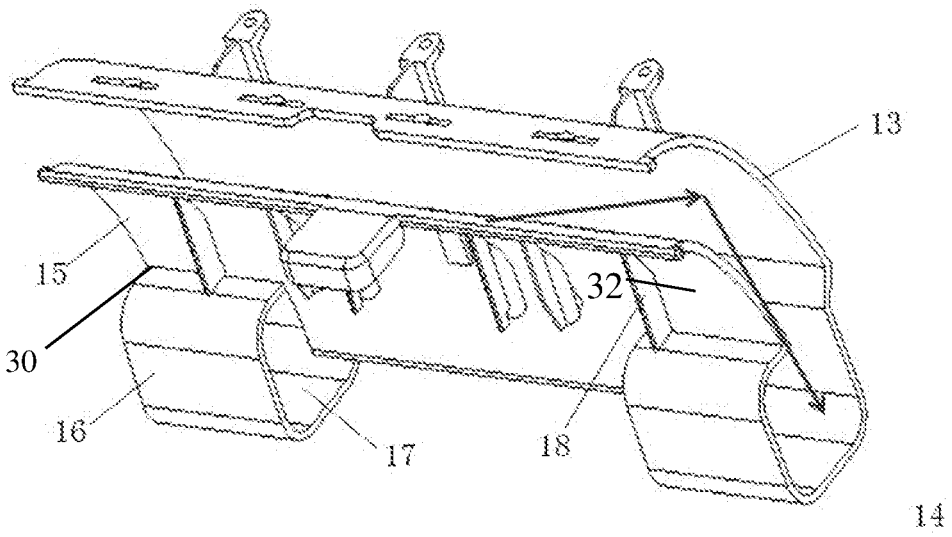
FIG. 6 is an overall structural view of the downward bent paper box, in which the arrows indicate the paper placement direction, of the automatic shredder according to the teachings of the present of the present invention.
Figure 7:
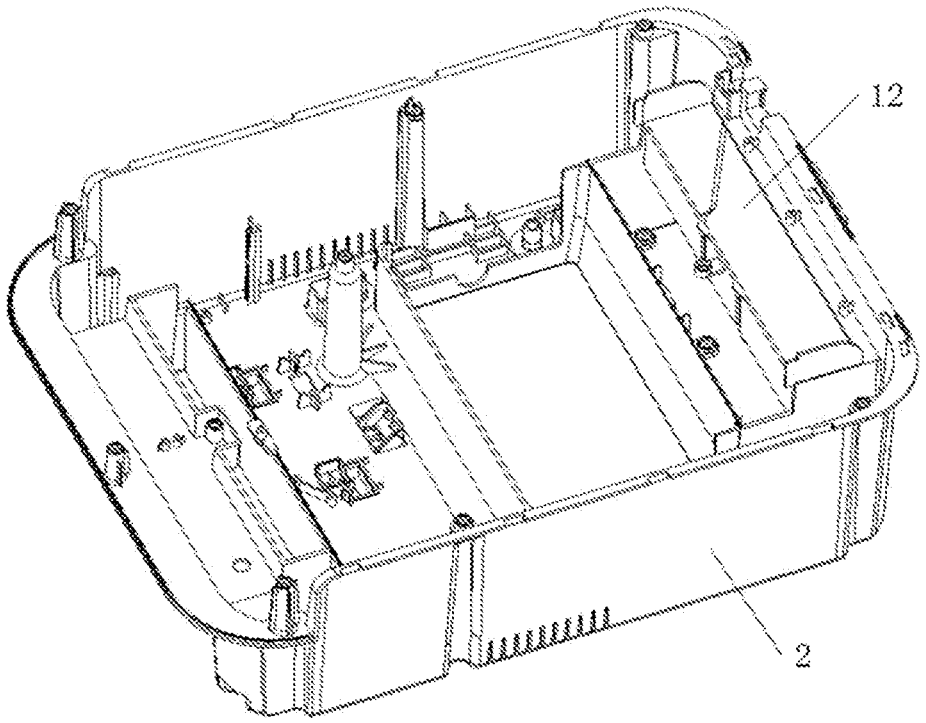
FIG. 7 is a structural view of a first accommodating cavity of the automatic shredder according to the teachings of the present of the present invention.

In an embodiment, an angle A between the downward bent paper box paper-stop wall 14 and the bottom plane of the first paper box 3 is smaller than or equal to 90 degrees, as shown in FIG. 1. In FIG. 2A, lower shredder cover is presented with an upper shredder cover. The arrows indicate the paper placement direction, a second paper box is a bent paper box. In FIG. 3, the direction of the arrows indicate proper placement direction. As shown in FIG. 6, portions of left and right ends of the downward bent paper box lower wall 15, close to the downward bent paper box paper-stop wall 14, expand outwards to form first paper accommodating boxes 16 respectively. Bevel portions 33 of joints of the left and right first staple accommodating boxes 16 and the downward bent paper box lower wall 15 are used for removing staples or clips on the bottom piece of paper in the stack of to-be-shredded paper. Two inner side faces, facing each other, of the left and right staple accommodating boxes 16 are first staple removing part open faces 17, and are communicated with the waste paper barrel 40 to remove redundant staples or clips.

In an embodiment, the downward bent paper box upper wall 13, the downward bent paper box paper-stop wall 14, the first staple accommodating boxes 16 and the downward bent paper box lower wall 15 can be manufactured integrally. Furthermore, first staple removing plates 30 are disposed on the bevel portions 33 of the joints of the left and right first staple accommodating boxes 16 and the downward bent paper box lower wall 15. In an embodiment, first staple removing plates 30 are made of metal materials. In this embodiment, the first staple removing plates 30 made of metal materials can effectively improve the staple removing efficiency and have a longer service life.

Further referring to FIG. 6, a plurality of first reinforcing ribs 18 are disposed between upper sides of the first staple accommodating boxes 16 and the downward bent paper box lower wall 15. Due to the fact that frequent staple removal may accelerate abrasion of the first staple accommodating boxes 16 and the downward bent paper box lower wall 15 in actual operation, the first reinforcing ribs 18 are arranged to effectively prolong the service life of the downward bent paper box.

Figure 5:
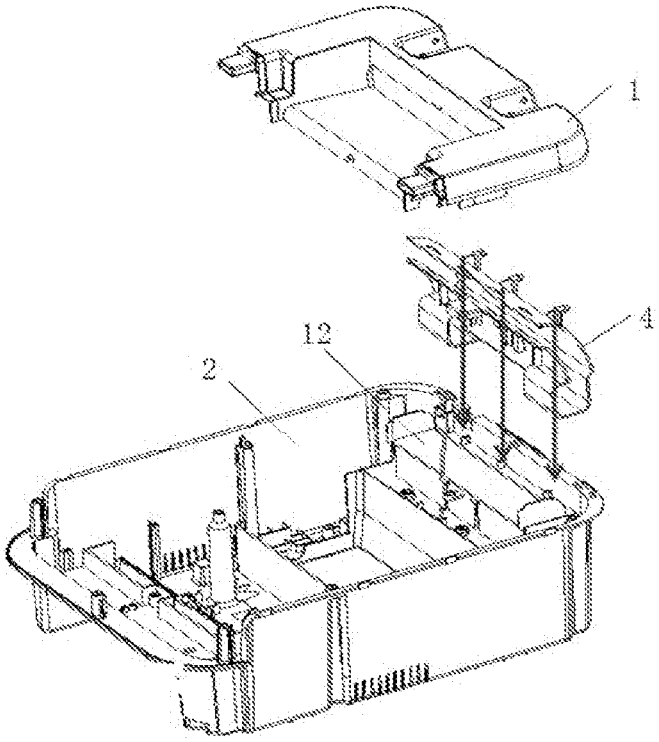
FIG. 5 is an exploded structural view of the downward bent paper box, the upper shredder cover and the lower shredder cover in which the arrows indicate the assembly direction of the automatic shredder according to the teachings of the present of the present invention.
Figure 9:
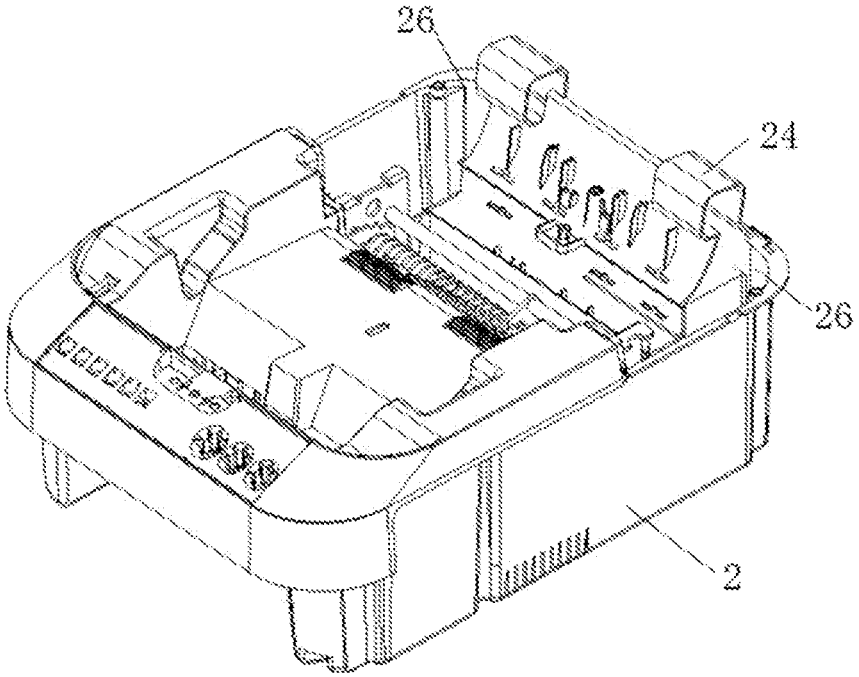
FIG. 9 is an overall structural view of an upward bent paper box in which the arrows indicate the paper placement direction of an automatic shredder according to the teachings of the present of the present invention.
Figure 10:
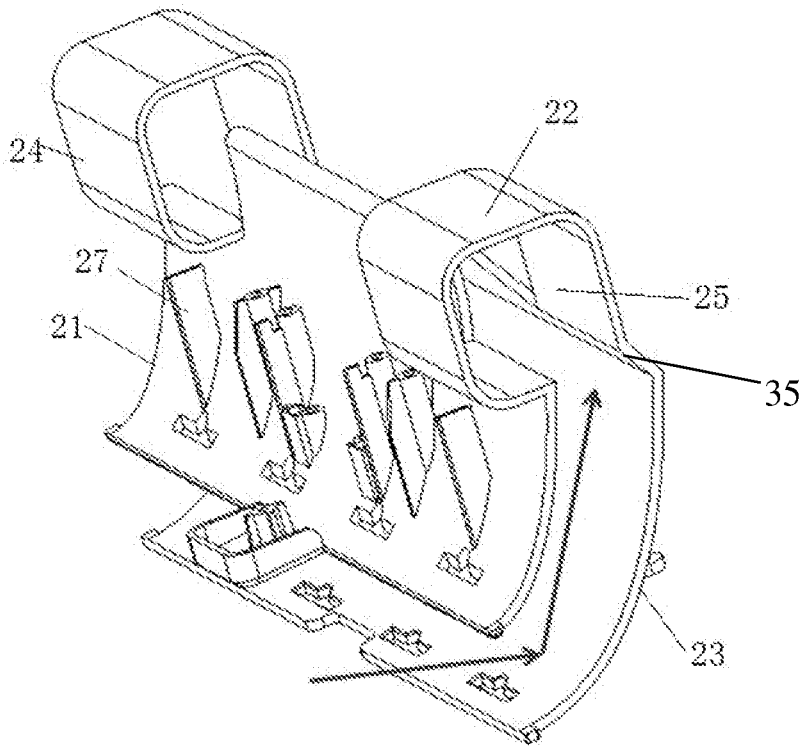
FIG. 10 is an installation diagram of the upward bent paper box of the automatic shredder of the invention.
Figure 11:
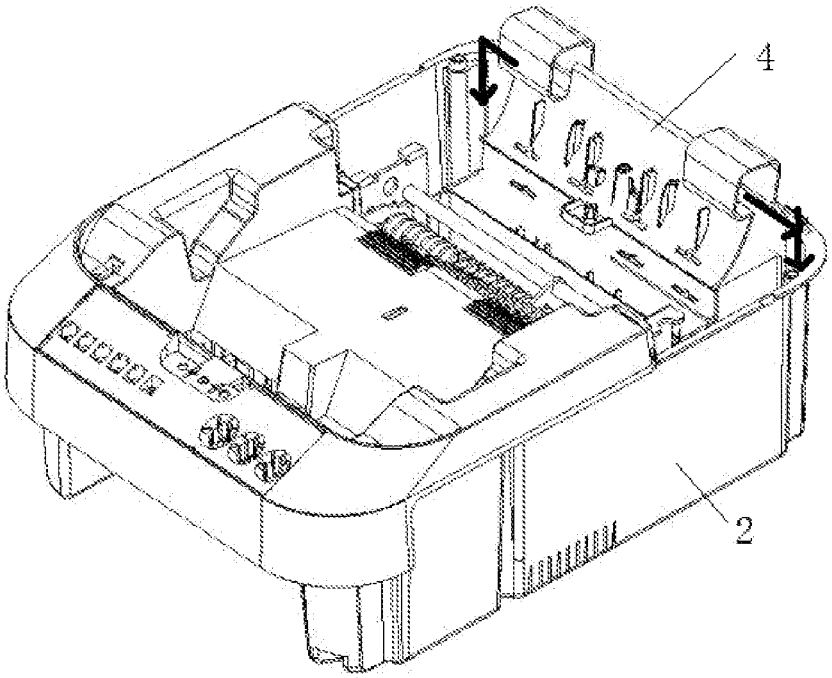
FIG. 11 is a schematic diagram of the moving direction of removed staples of the automatic shredder according to the teachings of the present of the present invention.

As shown in FIG. 5, a first accommodating cavity 12 is formed in the lower shredder cover 2 to accommodate the downward bent paper box. In another embodiment, when the second paper box 4 is the upward bent paper box (as shown in FIG. 8-FIG. 10), the upward bent paper box is a semi-open upward bent cavity which is formed by an upward bent paper box upper wall 21, an upward bent paper box paper-stop wall 22 and an upward bent paper box lower wall 23 connected in sequence, is fixedly connected to the upper shredder cover 1, and is communicated and combined with the first paper box 3 to accommodate a stack of to-be-shredded paper (also suitable for a piece of paper).

In an embodiment, the bottom plane of the first paper box 3 inclines upwards gradually from an end away from the upward bent paper box to an end close to the upward bent paper box, so that the user can place the stack of to-be-shredded paper on the paper support box easily, and the friction between the stack of to-be-shredded paper is reduced. In actual operation, the bottom plane of the first paper box 3 may also be horizontal, which is not most beneficial to paper placement.

In an embodiment, the length of the upward bent paper box is smaller than or equal to a quarter of the paper length. In this embodiment, the length of the upward bent paper box should not be smaller than or equal to half of the paper length for the following reason: since the upward bent paper box is disposed in the upper shredder cover 1, the solution where "the length of the downward bent paper box is less than or equal to half of the paper length" will inevitably increase the height of the upper shredder cover 1. To decrease the length of the first paper box 3 and the height of the upper shredder cover 1, the solution where "the length of the upward bent paper box is smaller than or equal to a quarter of the paper length" in this embodiment is more appropriate and can decrease the length of the first paper box 3 to a great extent, thus effectively reducing the size of the shredder, and the upper shredder cover 1 is prevented from being too clumsy.

Figure 8:
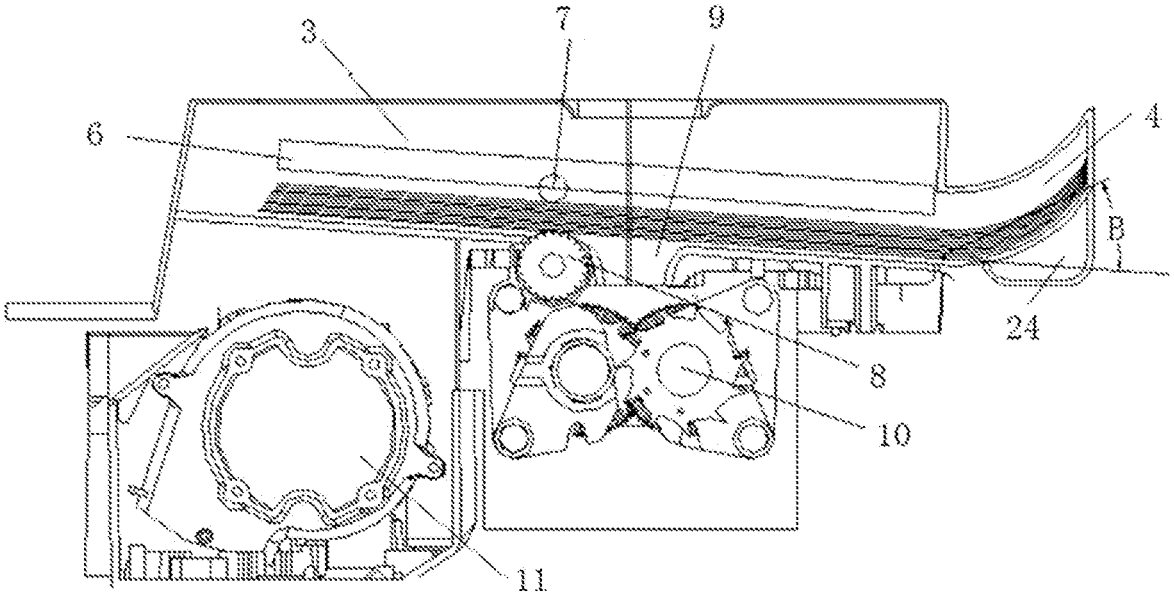
FIG. 8 is a second sectional view of the automatic shredder according to the teachings of the present of the present invention.

In an embodiment, an angle B between the upward paper box paper-stop wall 22 and the bottom plane of the paper support box 3 is smaller than or equal to 90 degrees, as shown in FIG. 8. Furthermore, portions, close to the upward bent paper box paper-stop wall 22, of left and right ends of the upward bent paper box lower wall 23 expand outwards to form second staple accommodating boxes 24 respectively. Bevel portions 33 of joints of the left and right second staple accommodating boxes 24 and the upward bent paper box lower wall 23 are used for removing staples or clips on the bottom piece of paper in the stack of to-be-shredded paper. Two outer side faces, backing onto each other, of the left and right second staple accommodating boxes 24 are second staple removing part open faces 25, and are communicated with the waste paper barrel 40 through two through holes 26 formed in two corners of the lower shredder cover 2 to remove redundant staples or clips, as shown in the figures. In this embodiment, two inner side faces of the left and right second staple accommodating boxes 24 are sealed and incline outwards to allow removed staples or clips to move towards the through holes 26 in the two corners of the lower shredder cover 2

In an embodiment, the upward bent paper box upper wall 21, the upward bent paper box paper-stop wall 22, the second staple accommodating boxes 24 and the upward bent paper box lower wall 23 are manufactured integrally. Furthermore, second staple removing plates 35 are disposed on the bevel portions 33 of the joints of the left and right second staple accommodating boxes 24 and the upward bent paper box lower wall 23. In an embodiment, the second staple removing plates 35 are made of metal materials. In this embodiment, the second staple removing plates 35 made of metal materials can effectively improve the staple removing efficiency and have a longer service life.

Further referring to FIG. 10, a plurality of second reinforcing ribs 27 are disposed between upper sides of the second staple accommodating boxes 24 and the upward bent paper box lower wall 23. Due to the fact that frequent staple removal may accelerate abrasion of the second staple accommodating boxes 24 and the upward bent paper box lower wall 23 in actual operation, the second reinforcing ribs 27 are arranged to effectively prolong the service life of the upward bent paper box. Furthermore, a second accommodating cavity 20 is formed in the upper shredder cover 1 to accommodate the upward bent paper box.

The foregoing description is merely for explaining preferred specific implementations of the invention, but is not intended to the limit the protection scope of the invention. All transformations or substitutions easily obtained by anyone skilled in the art should fall within the protection scope of the invention. Thus, the protection scope of the invention should be subject to the protection scope defined by the claims.

What is claimed is:

1. An automatic shredder, comprising:

an upper shredder cover;

a lower shredder cover;

a first paper box;

a second paper box;

a shredder cover plate;

a paper pressing plate;

a paper pressing roller set;

a paper pick-up roller set;

a paper inlet;

a cutter shaft set;

a drive motor;

a shell, and a waste paper barrel, wherein:

the upper shredder cover is fixedly connected to the lower shredder cover, the first paper box is disposed at one end of an inner side of the lower shredder cover, the second paper box is disposed at another end of the inner side of the lower shredder cover, and is communicated and combined with the first paper box to accommodate a stack of to-be-shredded paper, the shredder cover plate is connected to one end of the upper shredder cover through a pivot and is used for opening or closing the shredder, the paper pressing plate is fixedly connected to a lower end face of the shredder cover plate and at least comprises a horizontal pressing plate for pressing the stack of to-be-shredded paper placed on the first paper box when a user closes the shredder cover plate, the paper pressing roller set is disposed on one side of the paper pressing plate and vertically corresponds to the paper pick-up roller set, the paper inlet is formed in the first paper box, the cutter shaft set is disposed inside the lower shredder cover, located under the paper inlet and used for shredding the stack of to-be-shredded paper, the drive motor is disposed inside the lower shredder cover, electrically connected to the cutter shaft set and the paper pick-up roller set, and used for driving the cutter shaft set and the paper pick-up roller set to operate, the paper pick-up roller set is disposed inside the lower shredder cover, is located on a side of the cutter shaft set away from the second paper box, and is driven by the drive motor to rotate to enable a bottom piece of paper in the stack of to-be-shredded paper on the paper support box to move towards the second paper box and then move reversely under a reactive force of a side wall of the second paper box to be bent and deformed at the paper inlet so as to downward enter the paper inlet, the shell is disposed below the lower shredder cover and is fixedly connected to the lower shredder cover, and the waste paper barrel is disposed inside the shell for collecting shredded paper.

2. The automatic shredder according to claim 1, further comprising a staple accommodating groove concavely formed in an end of the first paper box away from the second paper box and used for collecting removed staples or clips.

3. The automatic shredder according to claim 2, wherein a staple removing plate is disposed on a bevel portion of a joint of the staple accommodating groove and a bottom plane of the first paper box.

4. The automatic shredder according to claim 1, wherein the first paper box and the second paper box are manufactured integrally or separately.

5. The automatic shredder according to claim 4, wherein when the first paper box and the second paper box are manufactured separately, the second paper box and the first paper box are connected to the upper shredder cover in a screwed manner, a clamped manner, a riveted manner, or a welded manner.

6. The automatic shredder according to claim 1, wherein the sum of a length of the first paper box and a length of the second paper box is equal to a paper length of the to-be-shredded paper.

7. The automatic shredder according to claim 6, wherein the length of the second paper box is less than or equal to half of the paper length.

8. The automatic shredder according to claim 7, wherein the length of the second paper box is less than or equal to a quarter of the paper length.

9. The automatic shredder according to claim 1, wherein a width of an inlet of the second paper box is equal to that the first paper box.

10. The automatic shredder according to claim 2, wherein the second paper box is a downward bent paper box, or an upward bent paper box.

11. The automatic shredder according to claim 2, wherein an upper surface of the second paper box, and an upper surface of the first paper box are located in one and the same plane that extends horizontal or oblique.

12. The automatic shredder according to claim 11, wherein an angle between a side wall of the second paper box away from the first paper box and a bottom plane of the first paper box is less than or equal to 90 degrees.

13. The automatic shredder according to claim 11, wherein the paper pressing plate further comprises a vertical pressing plate, the horizontal pressing plate presses the stack of to-be-shredded paper on the first paper box, and the vertical pressing plate presses a portion, close to the staple accommodating groove, of the stack of to-be-shredded paper into the staple accommodating groove.

14. The automatic shredder according to claim 10, wherein when the second paper box is the downward bent paper box, the downward bent paper box is a semi-open downward bent cavity, formed by a downward bent paper box upper wall, a downward bent paper box paper-stop wall, and a downward bent paper box lower wall connected in sequence, is fixedly connected to the lower shredder cover, and is communicated and combined with the first paper box to accommodate the stack of to-be-shredded paper.

15. The automatic shredder according to claim 14, wherein a bottom plane of the first paper box inclines downward gradually from an end away from the downward bent paper box to an end close to the downward bent paper box.

16. The automatic shredder according to claim 14, wherein an angle between the downward paper box paper-stop wall and the bottom plane of the first paper box is less than or equal to 90 degrees.

17. The automatic shredder according to claim 14, wherein:

portions, of left and right ends of the downward bent paper box lower wall close to the downward bent paper box paper-stop wall expand outward to form first staple accommodating boxes respectively;

bevel portions of joints of the left and right first staple accommodating boxes and the downward bent paper box lower wall are used for removing staples or clips on a bottom piece of paper in the stack of to-be-shredded paper; and two inner side faces of the left and right first staple accommodating boxes facing each other are first staple removing part open faces, and are communicated with the waste paper barrel to remove redundant staples or clips.

18. The automatic shredder according to claim 14, wherein the downward bent paper box upper wall, the downward paper box paper-stop wall, the first staple accommodating boxes, and the downward paper box lower wall are integrally manufactured.

19. The automatic shredder according to claim 14, wherein first staple removing parts are disposed on the bevel portions of the joints of the left and right first staple accommodating boxes and the downward bent paper box lower wall.

20. The automatic shredder according to claim 14, wherein a plurality of first reinforcing ribs are disposed between upper sides of the first staple accommodating boxes and the downward bent paper box lower wall.

21. The automatic shredder according to claim 10, wherein a first accommodating cavity is formed in the lower shredder cover to accommodate the downward bent paper box.

22. The automatic shredder according to claim 10, wherein when the second paper box is the upward bent paper box, the upward bent paper box is a semi-open upward bent cavity formed by an upward bent paper box upper wall, an upward bent paper box paper-stop wall, and an upward paper box lower wall connected in sequence, is fixedly connected to the upper shredder cover, and is communicated and combined with the first paper box to accommodate the stack of to-be-shredded paper.

23. The automatic shredder according to claim 22, wherein a bottom plane of the first paper box inclines upwards gradually from an end away from the upward bent paper box to an end close to the upward bent paper box.

24. The automatic shredder according to claim 22, wherein an angle between the upward bent paper box paper-stop wall and the bottom plane of the first paper box is less than or equal to 90 degrees.

25. The automatic shredder according to claim 22, wherein:

portions, of left and right ends of the upward bent paper box lower wall close to the upward bent paper box paper-stop wall expand outwards to form second paper accommodating boxes respectively;

bevel portions of joints of the left and right second staple accommodating boxes and the upward bent paper box lower wall are used for removing staples or clips on a bottom piece of paper in the stack of to-be-shredded paper; and two outer side faces, of the left and right second staple accommodating boxes backing onto each other are second staple removing part open faces, and are communicated with the waste paper barrel through two through hole formed in two corners of the lower shredder cover to remove redundant staples or clips.

26. The automatic shredder according to claim 22, wherein the upward bent paper box upper wall, the upward bent paper box paper-stop wall, the second staple accommodating boxes, and the upward bent paper box lower wall are integrally manufactured.

27. The automatic shredder according to claim 22, wherein second staple removing plates are disposed on the bevel portions of the joints of the left and right second staple accommodating boxes and the upward bent paper box lower wall.

28. The automatic shredder according to claim 22, wherein a plurality of second reinforcing ribs are disposed between upper sides of the second staple accommodating boxes and the upward bent paper box lower wall.

29. The automatic shredder according to claim 10, wherein a second accommodating cavity is formed in the upper shredder cover to accommodate the upward bent paper box.

* * * * *